US007481495B2

(12) United States Patent
Wang

(10) Patent No.: US 7,481,495 B2
(45) Date of Patent: Jan. 27, 2009

(54) SYSTEM AND METHOD FOR MOUNTING WICKER

(75) Inventor: Oliver Wang, Kowloon (CN)

(73) Assignee: Agio International Company, Limited, Kowloon, Hong Kong (HK)

( * ) Notice: Subject to any disclaimer, the term of this patent is extended or adjusted under 35 U.S.C. 154(b) by 315 days.

(21) Appl. No.: 11/445,350

(22) Filed: Jun. 1, 2006

(65) Prior Publication Data

US 2007/0278840 A1 Dec. 6, 2007

(51) Int. Cl.
*A47C 5/02* (2006.01)

(52) U.S. Cl. ..... 297/440.11; 160/392; 297/451.9; 297/452.64

(58) Field of Classification Search ..... 297/218.4, 297/226, 440.11, 451.9, 452.63, 452.64; 160/383, 392, 395
See application file for complete search history.

(56) References Cited

U.S. PATENT DOCUMENTS

| | | | | |
|---|---|---|---|---|
| 1,038,083 | A * | 9/1912 | Calef | 297/452.64 |
| 3,811,454 | A * | 5/1974 | Huddle | 160/395 |
| 3,851,848 | A * | 12/1974 | Wiele | 160/391 |
| 4,817,655 | A * | 4/1989 | Brooks | 160/392 |
| 4,848,843 | A * | 7/1989 | Gibbs | 297/440.22 |
| 5,716,101 | A * | 2/1998 | Frinier et al. | 297/440.22 |
| 5,762,403 | A | 6/1998 | Robinson | |
| 5,836,655 | A * | 11/1998 | Laufer | 297/452.63 |
| 6,179,382 | B1 | 1/2001 | Schwartz | |
| 6,292,987 | B1 * | 9/2001 | Combes | 24/460 |
| 6,560,827 | B1 * | 5/2003 | Gross | 297/440.11 |
| 6,585,323 | B2 | 7/2003 | Gaylord et al. | |
| 6,623,079 | B2 | 9/2003 | Gregory | |
| 6,702,378 | B2 | 3/2004 | Bullard | |
| 6,726,286 | B2 | 4/2004 | Stumpf et al. | |
| 6,779,849 | B1 | 8/2004 | Harper et al. | |
| 6,877,812 | B2 | 4/2005 | Congleton et al. | |
| 6,908,869 | B2 | 6/2005 | Haun et al. | |
| 7,125,081 | B2 * | 10/2006 | Church et al. | 297/440.11 |
| 2004/0000808 | A1 | 1/2004 | Maloney | |
| 2005/0200189 | A1 | 9/2005 | Schultz et al. | |

FOREIGN PATENT DOCUMENTS

| | | | |
|---|---|---|---|
| RU | 2185767 | C2 | 7/2002 |

* cited by examiner

*Primary Examiner*—Peter R. Brown
(74) *Attorney, Agent, or Firm*—Williams Mullen; M. Bruce Harper

(57) ABSTRACT

A method and system for mounting wicker fibers onto furniture frame members; the system involves a flexible securing rod and at least one frame member with a channel configured to retain the securing rod. The frame member provides at least one channel access point along the channel that enables the securing rod to be inserted fully into the channel and further to enable a portion of the securing rod to be manipulated to expose a portion of the securing rod so that a wicker fiber can be looped around the securing rod. The exposed portion of the flexible securing rod may then be re-inserted into the channel. Thus, in application a frame member may be incorporated into a furniture frame in a complementary configuration permitting the wicker fibers to be woven. The wicker may be looped about securing rods located in complementary frame members so as to create a sling mounted wicker panel.

13 Claims, 8 Drawing Sheets

SYSTEM AND METHOD FOR MOUNTING WICKER

FIELD OF THE INVENTION

The present invention relates to furniture construction, and more particularly, to furniture assembly employing a sling-type arrangement that enables the use of woven wicker as a surface within a furniture frame.

BACKGROUND OF THE INVENTION

Various types of furniture, such as chairs or settees, provide pliable surfaces suspended by a frame. Sling furniture (e.g., a "sling chair") generally includes a sling as a surface portion of the furniture, such as a back or seat of a chair. For example, a sling chair has a frame and a pliable yet supportive fabric panel mounted to the frame in one or more pieces to support the person sitting. The sling panel or panels are mounted to the frame in a way that suspends it in place and bears the weight of the sitting individual or other item. One typical means of mounting a sling is by a stitched or woven loop forming a sleeve or channel along opposing edges of the sling, into which flexible dowels are inserted, and the looped edges with dowel inserts are disposed in slotted keyway channels formed in the frame (e.g., in opposing seat members, so that a sling panel may be suspended between them). Another typical means of fastening is to have the opposing frame members inserted into the looped edges of the sling. In either case, when the opposing frame members are attached to the other frame members, the sling panel is suspended and supported. In addition to chairs, some forms of tables or other furniture employ sling mounted panels. Although a variety of mechanisms may have been employed for securing a sling to the frame, these conventional mechanisms have suffered several deficiencies.

First, conventional sling mechanisms have not permitted the use of materials such as wicker. Wicker is a fiber capable of being woven into a supportive pattern; traditionally wicker has been formed from plant fibers. Recent developments have enabled the fabrication of synthetic wicker having improved durability and simplified assembly. Accordingly, wicker materials are growing in popularity. However, wicker furniture has traditionally required a series of holes within the furniture frame, so that the wicker fibers could be looped or threaded through the frame during the weaving process; this requirement can be a complicating step that often requires hand work. This limitation also requires the preliminary step of drilling the plurality of holes into the frame in a pattern that supports the contemplated wicker designs for the panel. Because of this, some have resorted to using pressed cane, which is convenient. However, machine fabricate pressed cane appears artificial and often lacks the strength of traditional wicker.

An additional drawback to conventional sling designs is an order of frame assembly that requires mounting the sling onto the frame prior to completing frame assembly. That is, in many conventional designs, the flexible dowel must be inserted into the sleeves located on the sling, and then the sling is mounted onto the frame before it is possible to complete the frame assembly. Typically, frame members do not permit the dowel and sling to be inserted after completion of frame assembly. Thus, for conventional sling systems, the full assembly of the chair, including mounting of the sling, must take place at a single facility.

It would be advantageous to provide a manufacturing process for wicker sling-type furniture that avoids the complexity of wicker threading and the conventional requirement that the sling be mounted onto the frame during assembly of the frame. Then the frame may be assembled in one location and a sling, including woven wicker embodiments, might be mounted onto the frame at a separate location.

SUMMARY OF THE INVENTION

The present invention is a method and mounting system for use in furniture frames that allows for mounting of wicker as a comfortable, attractive, and sturdy woven panel for a sling, seat, back, surface, etc., as well as efficient frame assembly. As described above, the frame members on conventional sling furniture often feature channels that are adapted to receive one or more securing rods or dowels. For conventional furniture, these securing rods may be inserted into fabric sleeves or loops, so that the fabric clad securing rod can then be inserted into the channel. The channel typically is configured to retain the securing rod while the fabric sling is attached to the securing rod, thereby mounting the sling. In one conventional approach, the channel has a slot over the course of the channel for longitudinal access to the channel. In some designs, this slot may be wider than the diameter of the securing rod to permit the rod bearing the sling to be inserted into the channel via the slot; the channel wall must provide a lip or other feature to form a depression for retaining the securing rod after it has been inserted laterally through the slot and into the channel. In other designs, the channel slot is not as wide as the diameter of the securing rod. The rod and sling must somehow be inserted longitudinally into an open end of the channel prior to assembling the various frame components; the open end of the channel is often located in an open end of a frame member. As may be expected, this latter approach can further complicate fabrication.

In the present invention, the channel is modified to provide an area of increased slot width for only a portion of the channel, thereby forming one or more discrete access points distributed along the course of the channel. Further, in the present invention the securing rod is flexible and resilient. The channel access point should be wide and long enough to enable a flexible securing rod to be manipulated to permit the weaving of wicker about the securing rod, which can then be re-inserted into the channel within the frame member. Conventional sling mounting, being directed solely to cloth slings, do not accommodate the manipulation of a securing rod, which is frequently rigid.

One of the features of the present invention includes the ability to weave a wicker panel onto an assembled frame. When the securing rod is fully inserted, the channel produces an inlaid appearance for the wicker panel edge, as the wicker panel disappears into the slot. Additionally, the channel slot width on the frame member may be less than the diameter of the securing rod for much of the channel's course because the securing rod may be inserted into the channel at the channel access point. This enables the channel to retain the securing rod more effectively. The system of the present invention enables the mounting of a wicker panel or sling efficiently, attractively, and securely. Although the primary examples of the present invention described herein may be the seats or backs of chairs or settees, those skilled in the art will appreciate that the present invention may be used for panels within a variety of types of furniture using wicker, such as headboards, magazine racks, tables, etc. Accordingly, the term "furniture" in the present invention should be construed as including a wide variety of furniture for which a woven panel is desired.

DETAILED DESCRIPTION OF THE PREFERRED EMBODIMENTS

Figure 1:
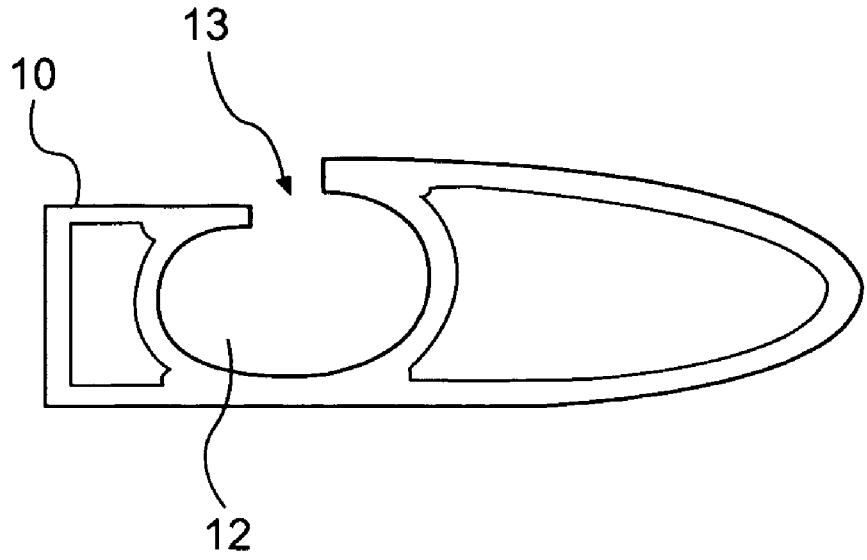
FIG. 1 is a cross sectional view of a frame member of the present invention.
Figure 2:
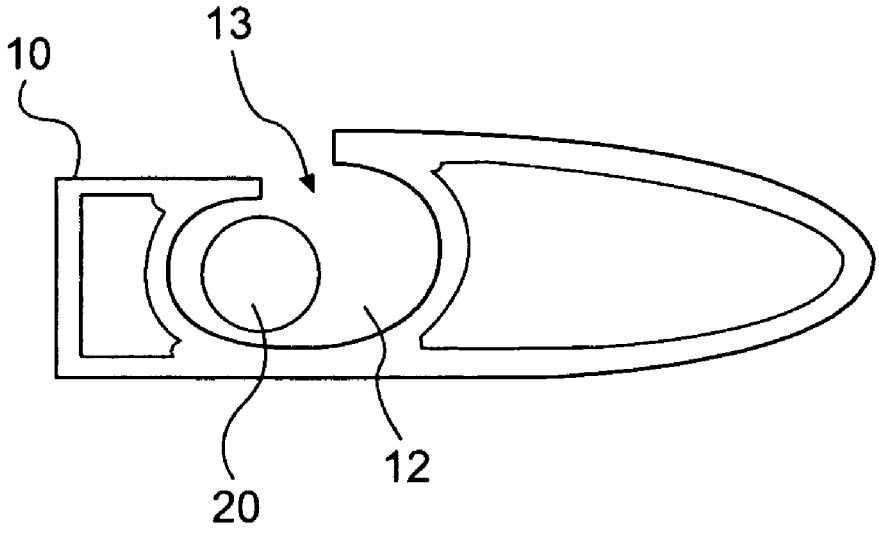
FIG. 2 is a cross sectional view of a frame member of the present invention with a securing rod disposed within the channel.

As shown in FIGS. 1 through 5, the present invention is a mounting system involving frame member 10, which can be used as a structural component of a furniture frame. FIG. 1 shows a cross section of one embodiment of the frame member 10 of the present invention, defining channel 12 with slot 13 opening on a face of frame member 10. FIG. 2 is a cross section view of frame member 10 with securing rod 20 disposed in and retained by channel 12. Securing rod 20 is generally flexible and preferably, though not necessarily, substantially cylindrical. The profile of securing rod 20 and channel 12 preferably are complementary to permit firm seating of securing rod 20 in channel 12 during use. If securing rod 20 is a shape other than cylindrical, then channel 12 should be adapted to retain such shape; a cylindrical shape is generally easier to manipulate and nests well into rounded channel 12 as shown. In general, however, channel 12 and frame member 10 may take any of a wide variety of configurations. A simple embodiment of frame member 10 to retain securing rod 20 is by sizing slot 13 of channel 12 smaller than the diameter of securing rod 20; those skilled in the art will acknowledge that other profiles or shapes may be employed so long as this function is preserved. Thus, channel 12 and slot 13 are sized and configured to retain securing rod 20, while slot 13 is an aperture from channel 12 to the face or surface of frame member 10 for wicker fiber 30 (not shown).

Figure 3:
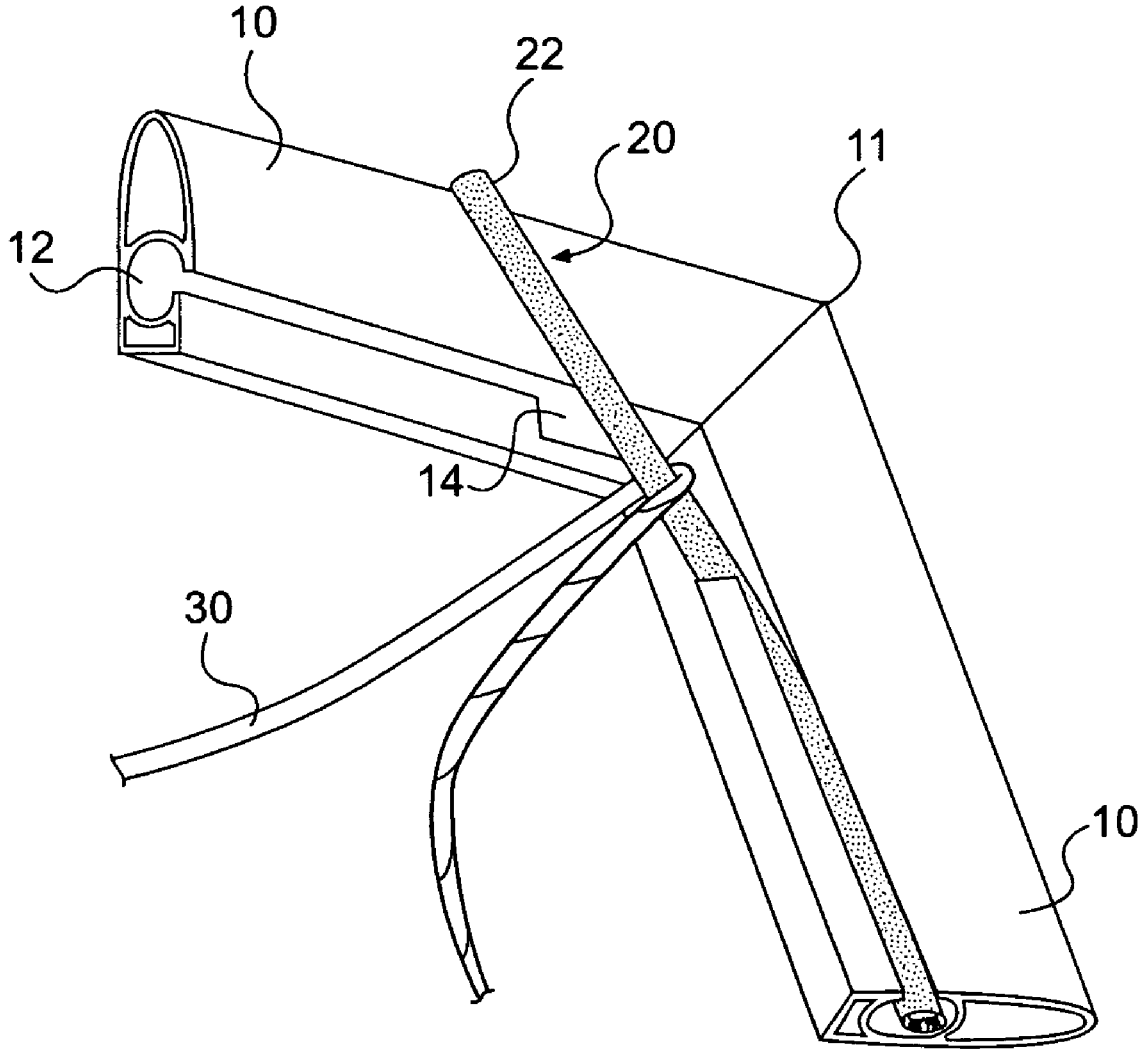
FIG. 3 is an elevation view of the frame member with securing rod manipulated out of the channel access and a wicker fiber is being wrapped around securing rod.

FIG. 3 is an elevated view of two frame members 10 mitered together at optional joint 11, with securing rod 20 partly inserted into channel 12 of one of the frame members 10. Securing rod 20 has been lifted, bent, or manipulated at channel access point 14 so that wicker fiber 30 may be looped about exposed portion 22 of securing rod 20. Once wicker fiber 30 is looped about securing rod 20, it may be positioned along securing rod 20 to the desired location on frame member 10 and then used in weaving a wicker panel 40 (not shown), as known in the art of weaving wicker. Other wicker fibers 30 may subsequently be looped about securing rod 20, or the exposed portion 22 of securing rod 20 may then be reinserted into channel 12, where it will be retained. The profile of channel 12 is visible in the cross sections of frame members 10.

Thus, the method of using the present invention comprises the steps or providing and inserting a securing rod 20 into channel 12 located on frame members 10 having channel access point 14. Securing rod 20 may then be manipulated at channel access point 14 to pull an exposed portion 22 of securing rod 20 upward to form an accessible or exposed portion or bend in securing rod 20. Depending on the embodiment, this may be done by hand or with any suitable tool, such as pliers, or a pick (not shown). Then one may pass or wrap wicker fiber 30 around exposed portion 22 of securing rod 20 and reinsert securing rod 20 into channel 12. Of course, the size of channel access point 14 will be influenced by the size and shape of channel 12, the size of securing rod 20, and the size of wicker fiber 30.

The method described above may be performed after assembly of the chair frame. This feature permits the seat, back and/or other panel to be installed or replaced at a location separate from the location of assembly, if desired. It is contemplated within the scope of the present invention to provide chair frames and weaving kits to enable consumers who desire to weave their own panels to engage in such craft.

Figure 4:
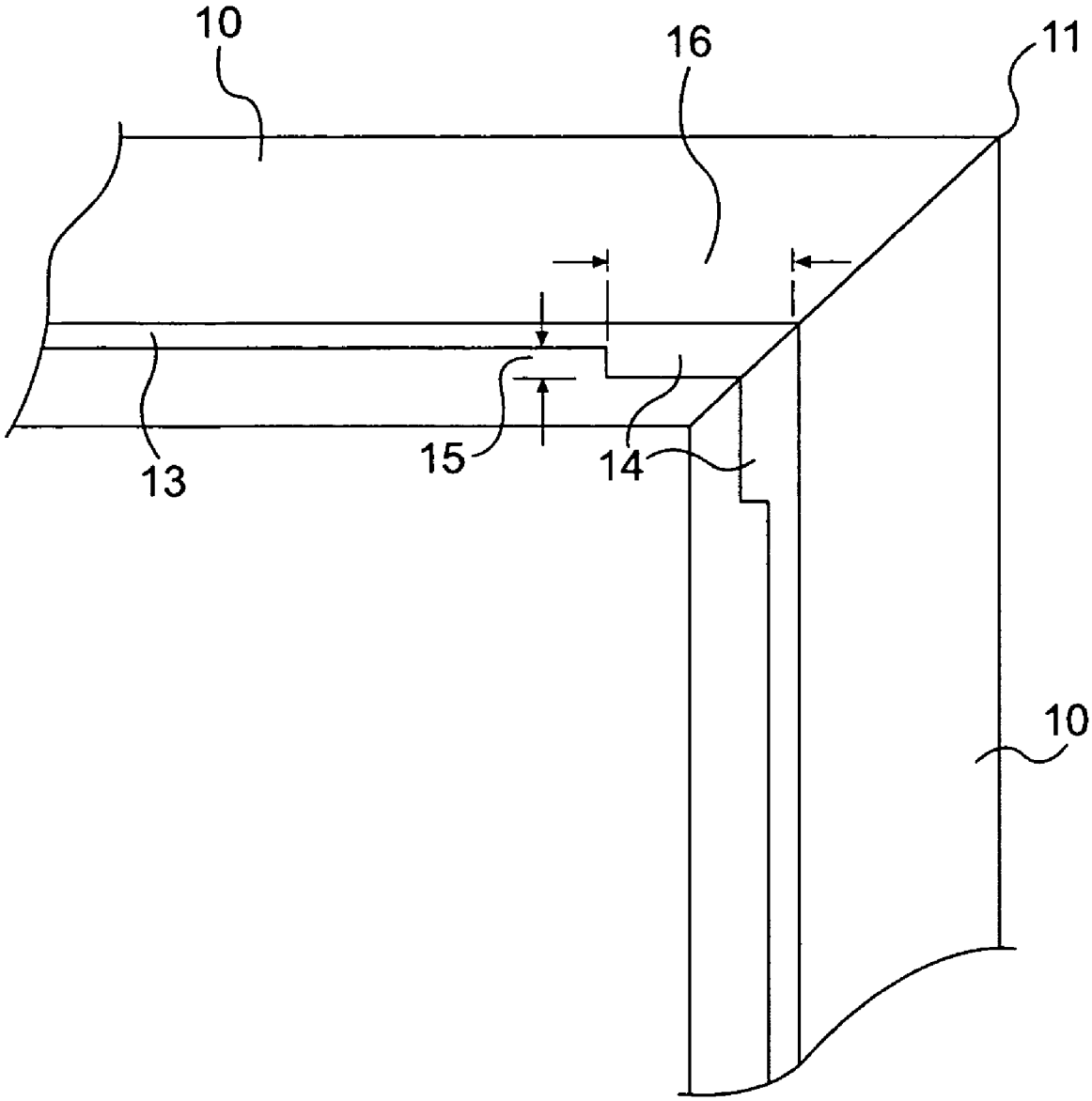
FIG. 4 is a top view of the frame member showing the configuration of channel access.

FIG. 4 is a top view of two frame members 10 mitered together at optional joint 11. Channel access point 14 is clearly visible from this perspective. For embodiments fabricated from substantially straight frame members 10, channel access points may preferably, though not necessarily, be situated near optional joint 11 for ease of insertion and manipulation, while also providing secure retention, as shown. Channel access point 14 preferably is of size and width to permit initial insertion of rod 20 and removal of an exposed portion 22 of securing rod 20 without interfering with channel 12 retention of securing rod 20 when fully inserted. Additionally, channel access point 14 should permit manipulation of securing rod 20 for the weaving process described above. Channel access point 14 in FIG. 4 is a widening of slot 13 by which securing rod 20 may be reached for insertion, manipulation, or removal. For example, in one illustrative embodiment with a securing rod 20 having a diameter of 6 mm and a channel 12 with a slot 13 having a width somewhat less than 6 mm but greater than 2 mm, then a channel access point 14 having a lateral dimension (shown by 15) of 4 mm greater than slot's 13 width, and a longitudinal dimension (shown by 16) of 25 mm performed well. If a single channel access point 14 is situated in the middle of a long, straight frame member 10, then securing rod 20 may need to be fabricated of material sufficiently flexible to accommodate any increased manipulation needed for both insertion and weaving, while being sufficiently rigid to be retained by channel 12 during seating. That is, configuration and location of access point 14 should be done in consideration of the materials used for securing rod 20 and frame member 10.

Figure 5:
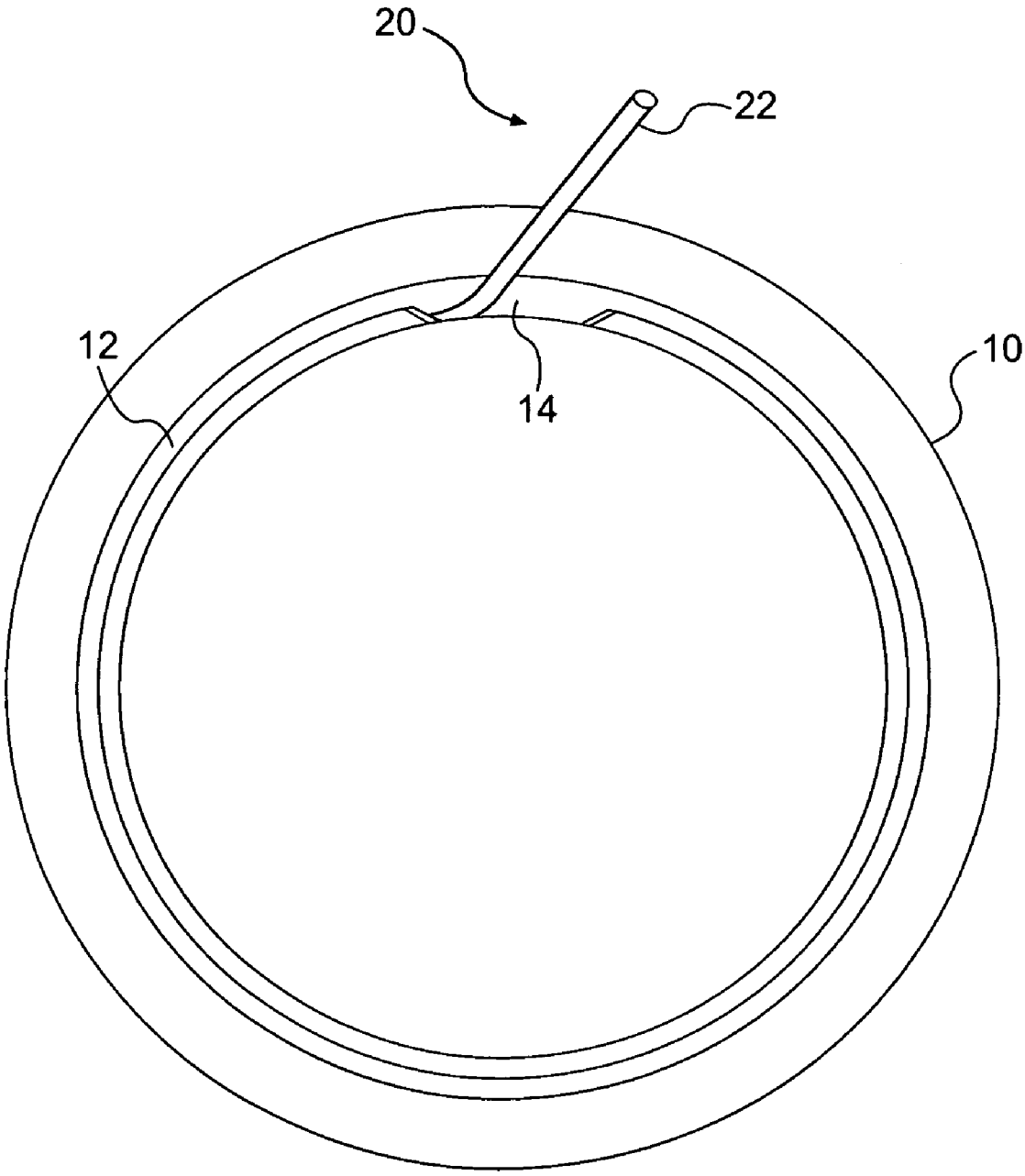
FIG. 5 is circular or curvilinear embodiment of the present invention.

Frame members 10 may be formed in a variety of shapes. FIG. 5 is a top view of a single piece curvilinear frame member 10; securing rod 20 is shown with exposed portion 22. The cross section of frame member 10 can be circular, oval, square, or any other shape, so long as it is capable of hosting channel 12, retaining securing rod 20, and enabling weaving of wicker 30. Further, so long as frame member 10 defines channel 12, frame member 10 may be solid or hollow and fashioned from a wide variety of materials, such as aluminum, steel, plastic, etc. Similarly, channel 12 within frame member 10 can be of a variety of profiles and lengths, so long as channel 12 is capable of retaining securing rod 20 and hosting at least one channel access point 14. In practice, the configuration of frame member 10 and channel 12 will depend in large part on the overall design of the furniture frame. Note that FIG. 5 shows a single frame member embodiment; the desired application will determine the complexity of the woven panel shape and the number of frame members 10 suitable for the furniture frame.

The method of joining multiple frame members 10 to each other, if applicable, may be by any conventional means, such as by fasteners, welding, or mating joint features (not shown). Preferably, though not necessarily, for embodiments having multiple frame members 10, channels 12 align at a joint 11 for a consistent and attractive appearance. In some embodiments, a single securing rod 20 may rest in or pass through multiple frame members 10. In other cases, it may be appropriate to provide a securing rod 20 for each frame member 10 or multiple securing rods 20 for different portions of a single frame member 10.

Frame members 10 are preferably used in fashioning a frame for furniture in which portions of the frame are complementary or interoperable. Presenting frame members 10 in opposing or adjacent orientation within the overall frame will enable at least one wicker fiber 30 to be woven into a panel 40 (not shown) for forming a surface, seat, back, or single piece panel sling mounted to the frame. That is, wicker fiber 30 may be looped about securing rod 20 located in frame members 10 in complementary orientation so as to create a sling mounted wicker panel.

Figure 6:
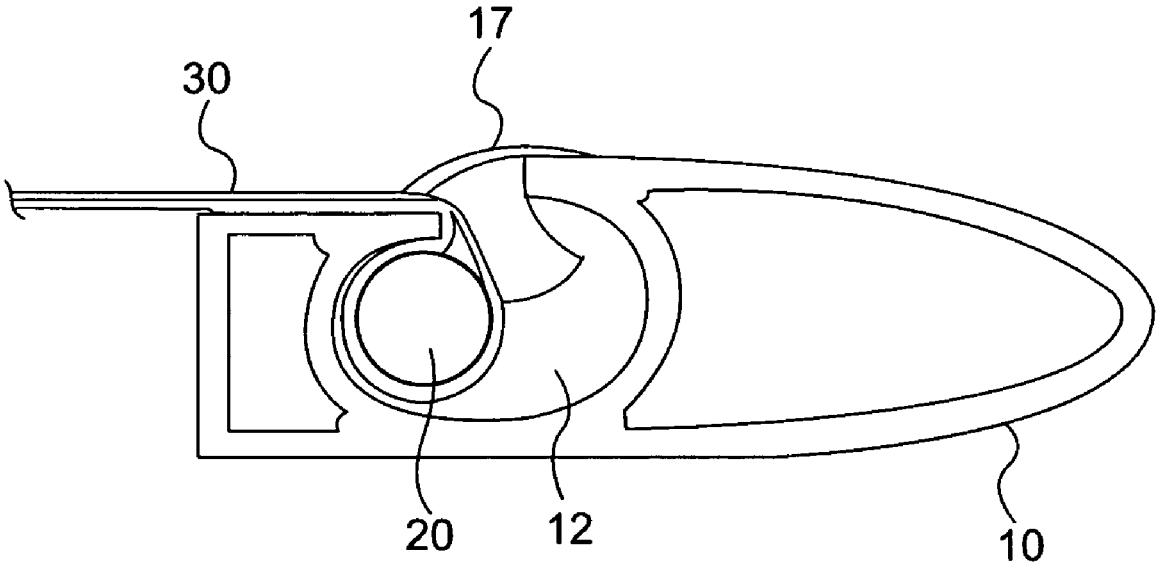
FIG. 6 is a cross sectional view of a frame member of the present invention in which a securing rod is located within the channel and a wicker yarn is looped around the securing rod; additionally, a cap is inserted into the channel.

FIG. 6 is a cross sectional view of frame member 10. Wicker fiber 30 is looped around securing rod 20, which is retained in channel 12. In this example, slot 13 of channel 12 is not visible because it is filled or sealed by optional cap 17 of plastic or other material, which may include a rubber or foam plug for insertion into and sealing slot 13 of channel 12, as shown. Optional cap 17 may run for a desired portion of the course of channel 12. Similarly, a larger optional cap (not shown) may be provided for insertion and sealing of channel access point 14.

Figure 7:
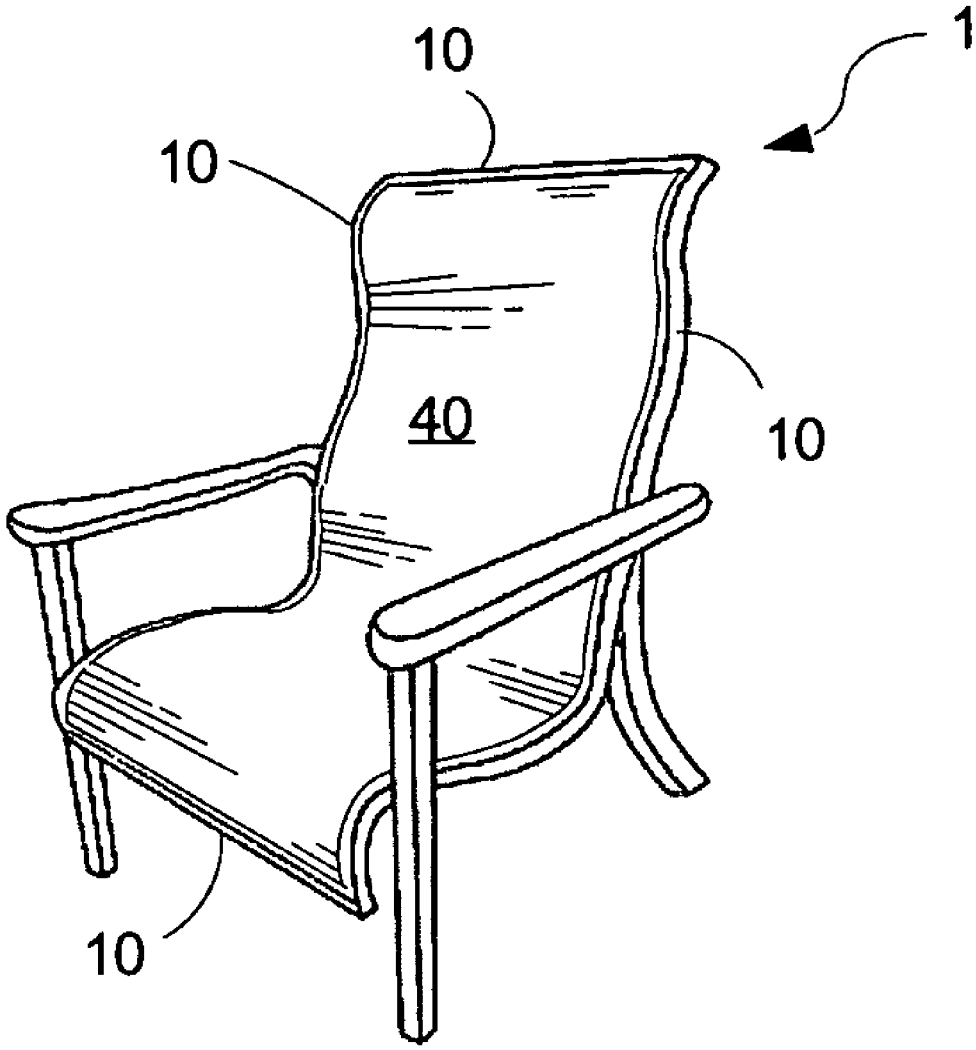
FIG. 7 is an embodiment of a wicker sling chair fabricated using the present invention.
Figure 8:
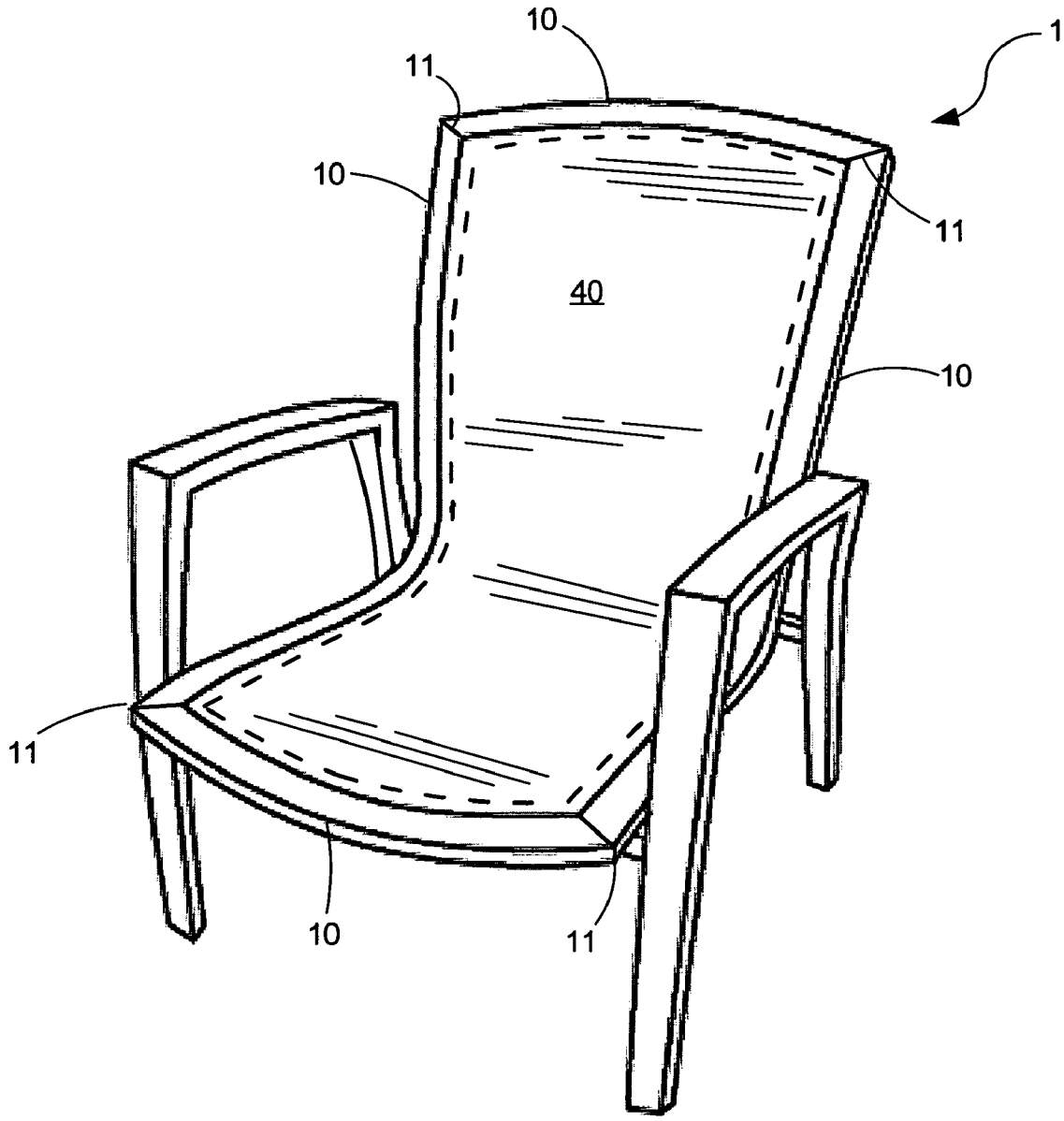
FIG. 8 is an embodiment of a wicker sling chair fabricated using the present invention.
Figure 9:
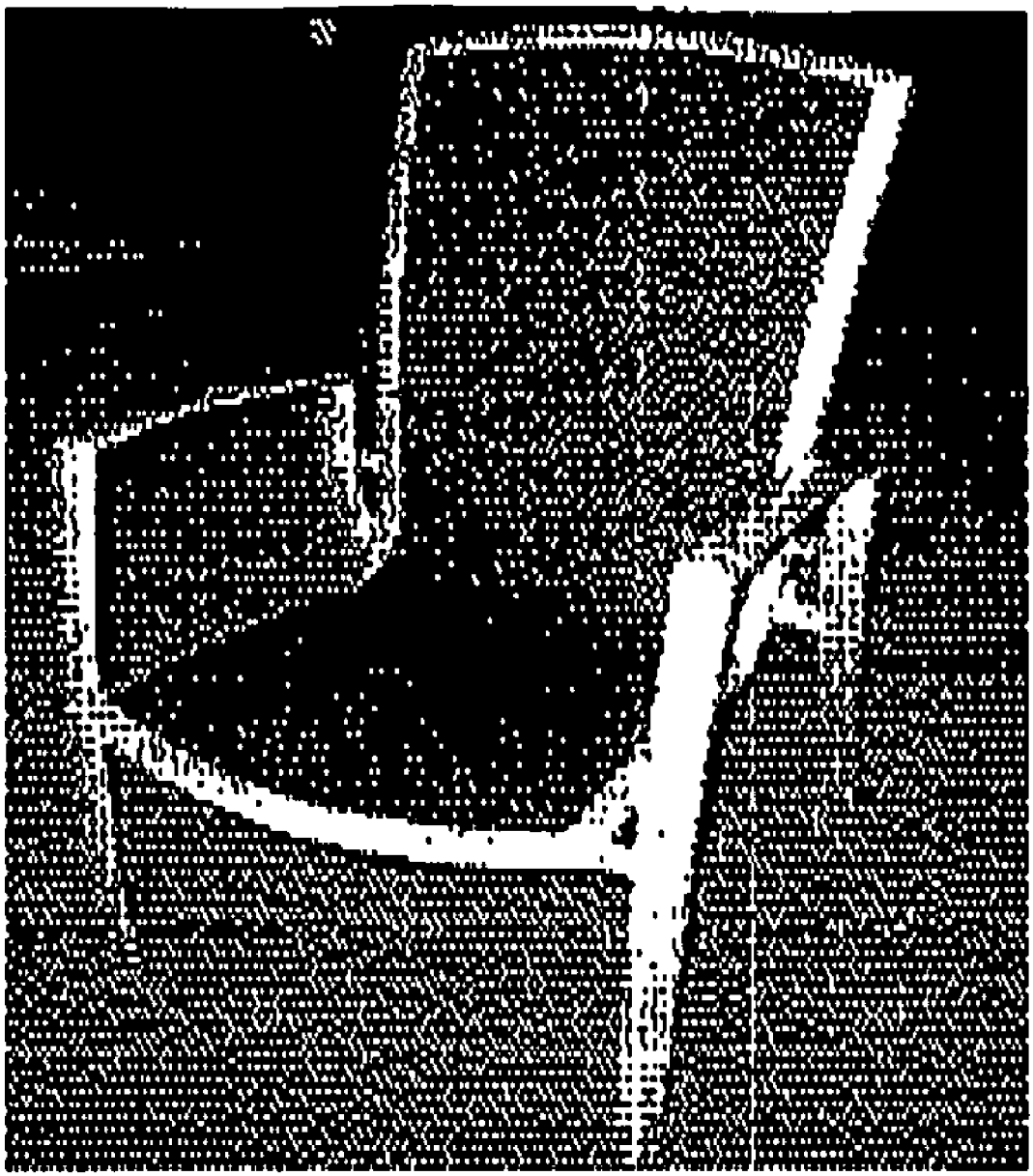
FIG. 9 is a photograph of an embodiment of the present invention.

FIGS. 7 and 8 are examples of chairs 1 fabricated using the method and system of the present invention. Wicker fiber 30 woven as weft may be visible or hidden by the warp, as may be desired for the application, the type of wicker fiber 30, and the configuration of frame members 10. Of course, the present invention may be used for assembly of a variety of applications of sling mounted furniture, such as wicker panels 40 for a table, a sling chair, a seat bottom, a seat back, an ottoman, a magazine rack, a day bed, a screen, etc. FIG. 9 is an embodiment of an assembled chair.

The present invention is not intended to be limited to any particular weave. Wicker fiber 30 may be used in any conventional arrangement of weave for creating a panel, as may be appropriate for the application. Such weaves may be plaited, herringbone, Danish cord, or any other pattern suitable to the application. Wicker fiber 30 may be natural or synthetic, with synthetic materials preferred for durability in wear and during assembly. Wicker fiber 30 may present any appropriate appearance, and is meant as a generic reference to weaving material, expressly including appearance of or substances such as rattan, cane, cord, etc., so long as the material is suitable for the desired weaving pattern and the furniture application.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

What is claimed is:

1. A mounting system for mounting wicker onto a frame of a piece of furniture, comprising:

at least one flexible securing rod having a diameter;

at least one wicker fiber having a width;

at least one frame member defining a recessed channel with a slot opening on one face of the frame member, the slot opening generally having a width that is at least substantially equivalent to the width of the at least one wicker fiber and less than the diameter of the flexible securing rod, the recessed channel configured so as to retain the securing rod when inserted into the channel;

wherein the at least one frame member further comprises at least one channel access point along the channel slot formed by a widening of the slot opening on the face of the frame member, the channel access point having a width at least greater than the diameter of the securing rod, wherein the channel access point is an opening into the channel that is long and wide enough to enable the securing rod to be inserted fully into the channel and further to enable a portion of the securing rod to be manipulated in a manner that exposes a portion of the securing rod sufficiently to permit the at least one wicker fiber to be looped around the exposed portion of the securing rod and the exposed portion of the securing rod may be then re-inserted into the channel; and wherein the at least one frame member is capable of being oriented within a furniture frame in a manner so as to permit the at least one wicker fiber to be woven.

2. The mounting system of claim 1, wherein the securing rod is substantially cylindrical.

3. The mounting system of claim 1, wherein the securing rod is substantially cylindrical and the channel includes at least one curvilinear side for retaining the securing rod.

4. The mounting system of claim 1, wherein the at least one frame member is substantially straight.

5. The mounting system of claim 1, wherein the at least one frame member is substantially curvilinear.

6. The mounting system of claim 1, further comprising a cap for sealing the slot in the channel.

7. The mounting system of claim 1, further comprising a cap for sealing the opening in the channel access point.

8. The mounting system of claim 1, wherein the at least one frame member forms a substantially rectangular portion of the furniture frame.

9. The mounting system of claim 1, wherein the at least one frame member forms a substantially oval portion of the furniture frame.

10. The mounting system of claim 1, wherein the at least one frame member comprises a substantially rectangular frame of four frame members joined together at substantially right angle joints and the at least one channel access point comprises four or more channel access points with at least one channel access point on each frame member situated near a joint.

11. A method for mounting a wicker fiber on a piece of furniture, comprising the steps of:

providing a flexible securing rod having a diameter;

providing at least one wicker fiber having a width;

providing at least one furniture frame member defining a recessed channel with a slot opening on one face of the frame member and a channel access point along the channel slot, the slot opening generally having a width that is at least substantially equivalent to the width of the at least one wicker fiber and less than the diameter of the flexible securing rod, the channel access point formed by a widening of the slot opening on the face of the frame member with a width at least greater than the diameter of the securing rod, and wherein the channel is configured to retain the securing rod when fully inserted into the channel;

inserting a securing rod into the channel via the channel access point;

manipulating the securing rod at the channel access point to expose a portion of the securing rod;

wrapping a wicker fiber around the securing rod; and re-inserting the securing rod into the channel.

12. A method for mounting a wicker fiber on a piece of furniture, comprising the steps of:

providing a flexible securing rod having a diameter;

providing at least one wicker fiber having a width;

providing at least one furniture frame member defining a recessed channel with a slot opening on one face of the frame member and a channel access point along the channel slot, the slot opening generally having a width that is at least substantially equivalent to the width of the at least one wicker fiber and less than the diameter of the flexible securing rod, the channel access point formed by a widening of the slot opening on the face of the frame member with a width at least greater than the diameter of the securing rod, and wherein the channel is configured to retain the securing rod when fully inserted into the channel;

at a first location, incorporating the at least one frame member into a furniture frame having complementary portions;

inserting the securing rod into the channel via the channel access point;

manipulating the securing rod at the channel access point to expose a portion of the securing rod;

wrapping a wicker fiber around the securing rod; and re-inserting the securing rod into the channel.

13. The method of claim 12, further comprising the step of moving the furniture frame incorporating the at least one frame member to a second location.

* * * * *